United States Patent [19]

Iwashita

[11] Patent Number: 4,493,659

[45] Date of Patent: Jan. 15, 1985

[54] TILT-LOCK MECHANISM

[75] Inventor: Takashi Iwashita, Hamakita, Japan

[73] Assignees: Yamaha Hatsudoki Kabushiki Kaisha; Sanshin Kogyo Kabushiki Kaisha, both of Japan

[21] Appl. No.: 326,553

[22] Filed: Dec. 2, 1981

[30] Foreign Application Priority Data

Dec. 3, 1980 [JP] Japan ..... 55-171374

[51] Int. Cl.[3] ..... B63H 5/12

[52] U.S. Cl. ..... 440/61; 188/299; 188/318; 188/300; 267/64.15

[58] Field of Search ..... 440/65, 61, 56, 55; 188/300, 318, 317, 322.13, 319, 314, 313, 315, 316, 299, 322.19, 281, 282, 286, 285; 267/64.12, 64.11, 64.15, 64.18, 64.22, 120, 124, 131, 117, 113; 248/640-643, 566, 567

[56] References Cited

U.S. PATENT DOCUMENTS

| | | | |
|---|---|---|---|
| Re. 27,932 | 2/1974 | Mettetal, Jr. | 440/61 |
| 2,953,335 | 9/1960 | Kiekhaefer | 440/61 X |
| 3,186,375 | 6/1965 | Cass | 440/61 |
| 3,246,915 | 4/1966 | Alexander, Jr. | 267/120 X |
| 3,285,221 | 11/1966 | North | 440/61 |
| 3,434,448 | 3/1969 | Woodfill | 440/61 |
| 3,434,450 | 3/1969 | McCormick | 440/61 |
| 3,722,455 | 3/1973 | Carpenter | 440/61 |
| 3,799,104 | 3/1974 | Kurling | 440/61 |
| 3,839,986 | 10/1974 | Meyer et al. | 440/61 |
| 3,863,592 | 2/1975 | Borst | 440/61 X |
| 3,885,517 | 5/1975 | Borst et al. | 440/61 |
| 3,888,203 | 6/1975 | Lohse | 440/61 |
| 3,983,835 | 10/1976 | Hall | 440/61 |
| 3,999,502 | 12/1976 | Mayer | 440/61 |
| 4,052,952 | 10/1977 | Hale et al. | 440/61 |
| 4,064,824 | 12/1977 | Hall | 440/61 |

FOREIGN PATENT DOCUMENTS

| | | | |
|---|---|---|---|
| 1068872 | 11/1959 | Fed. Rep. of Germany | 188/318 |
| 2915012 | 11/1980 | Fed. Rep. of Germany | 188/318 |

*Primary Examiner*—Douglas C. Butler

*Attorney, Agent, or Firm*—Ernest A. Beutler

[57] ABSTRACT

A tilt-lock mechanism for a vertically tiltable outboard stern drive on a marine vessel preferably includes a hydraulic cylinder device dampingly connecting the drive unit and the vessel. The mechanism preferably includes apparatus allowing the operator to selectively prevent or allow the drive unit to freely tilt under various operating conditions.

11 Claims, 18 Drawing Figures

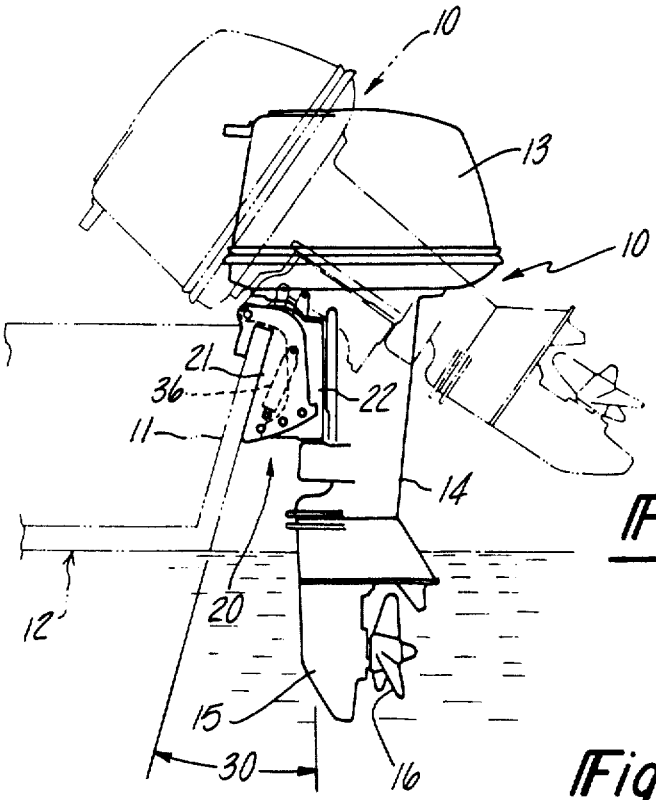
Fig-1
Fig-2
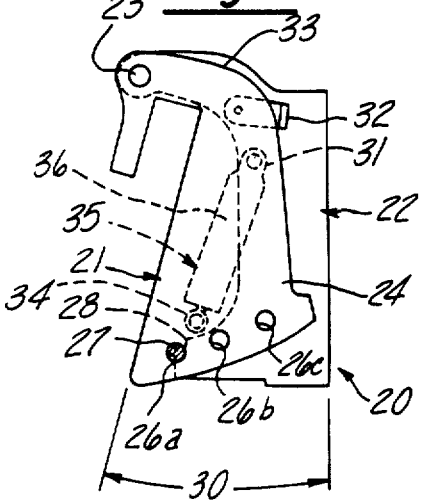
Fig-3
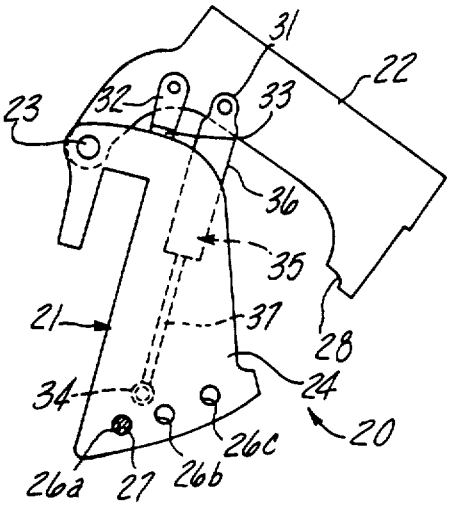

Fig-4
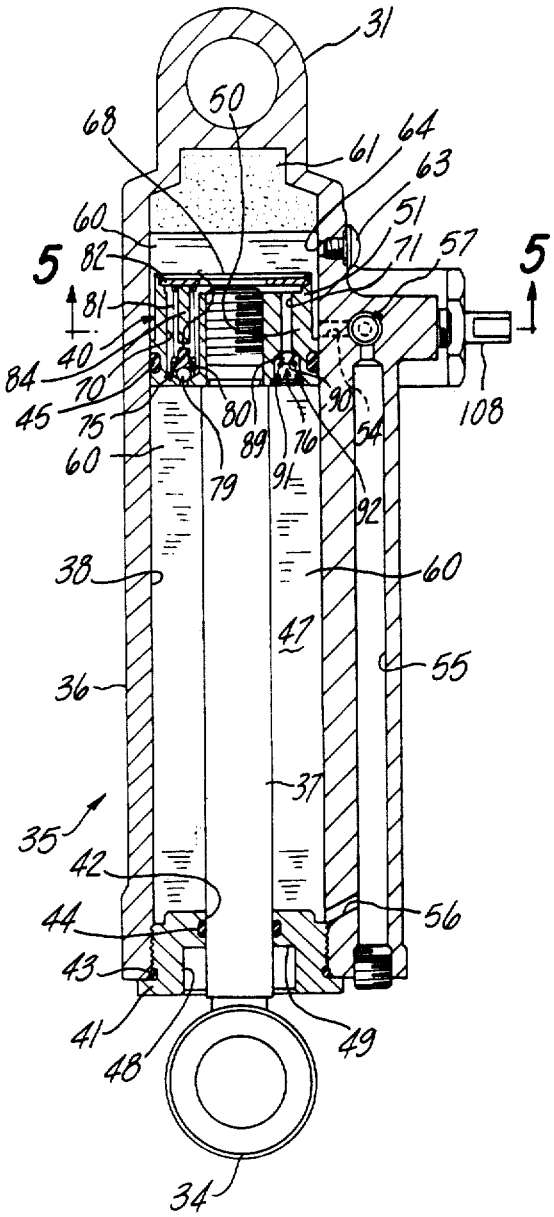
Fig-5
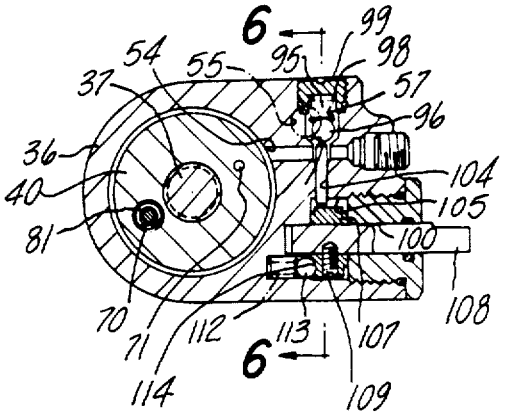
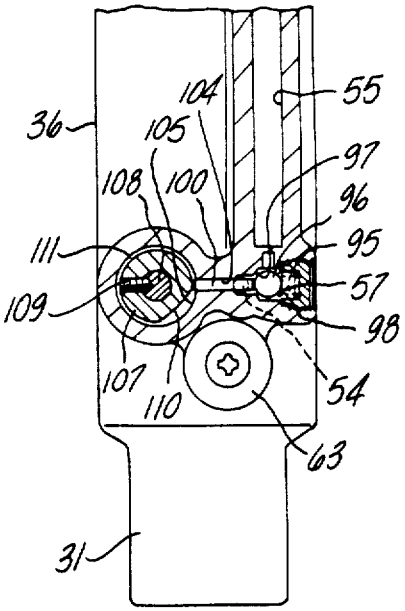
Fig-6

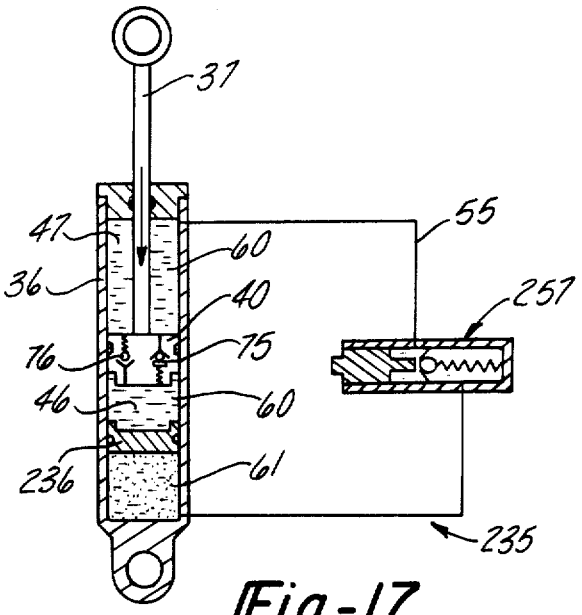
Fig-17
Fig-18
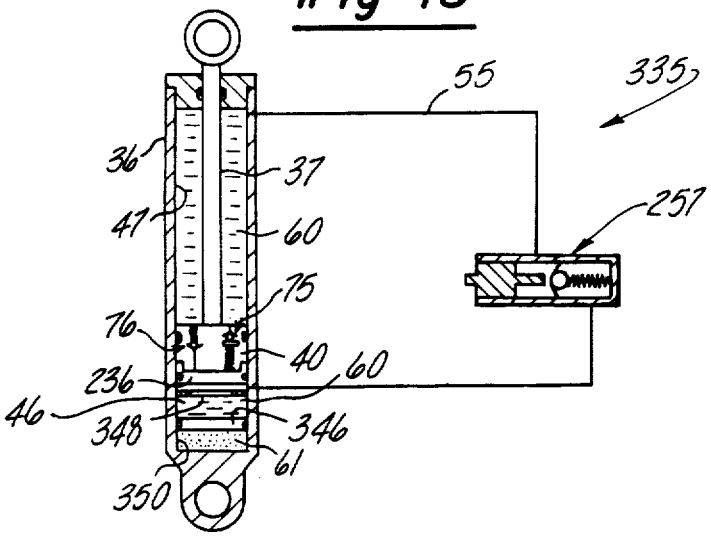

TILT-LOCK MECHANISM

BACKGROUND OF THE INVENTION

The invention relates to a support mechanism for a marine drive unit, such as an outboard engine or the outboard stern-drive portion of an inboard/outboard engine system, for boats, rafts and other marine vessels that permits tilting, trimming and locking of the unit. More particularly, the invention pertains to such mechanisms including fluid-pressurized apparatus for permitting various tilting, trimming and locking functions.

A typical outboard drive unit is attached to the stern of a marine vessel by means of a vertically pivotable support bracket that allows the drive unit to be selectively tilted downwardly into, or upwardly out of, the water. In order to perform satisfactorily, the drive unit should preferably be capable of being locked in its down position so that the drive unit does not swing upwardly due to the thrust of the propeller when the vessel is driven in the reverse direction. The locking system should preferably also prevent the drive unit from being swung upwardly by the resistance of the water when the vessel suddenly decelerates or stops. In order to prevent or at least minimize damage to the drive unit, however, the locking system preferably should automatically release and allow the drive unit to swing upwardly in the event of a collision with a submerged obstacle. The locking system preferably should also be selectively releasable by the operator so that the drive unit may be tilted out of the water for landing or storage.

Previous tilt-lock mechanisms typically attempt to perform some or all of the above functions by means of a multitude of interconnected linkages and springs that are inordinately complicated and expensive. Some previous tilt-lock systems, however, have substituted hydraulic, hydropneumatic, or gas-pressurized hydraulic apparatus for such linkages and springs but have either been unsuccessful in reducing the complexity and cost of the system or have been unable to adequately perform the required functions. Examples of such systems are set forth in U.S. Pat. Nos. 4,064,824; 4,052,952; 3,999,502; 3,983,835; 3,888,203; 3,863,592; 3,839,986; Re. 27,932; 3,722,455; 3,434,450; 3,434,448; and 3,285,221.

An examination of the prior art reveals that the need has arisen for a simple, inexpensive tilt-lock system for outboard drive units that is easy to operate and that adequately performs the above-discussed functions.

SUMMARY OF THE INVENTION

A mechanism for damping relative motion between two elements or members, such as an outboard drive unit on a marine vessel, preferably includes at least two fluid chambers having a restrictive fluid communication passage therebetween. Such a mechanism also preferably includes a selectively operable fluid bypass for overriding the restrictive fluid passage in order to permit free fluid flow between the chambers and free relative movement of the two elements or members. A blocking member is preferably included to disable the restricted fluid passage in order to prevent fluid flow therethrough after a predetermined amount of relative movement of such elements whenever said fluid bypass is selectively closed. The mechanism may also include a fluid accumulator adapted to compensate for displacement of the fluid by components of the mechanism during operation.

BRIEF DESCRIPTION OF THE DRAWINGS

FIG. 1 is a left-side elevation view of an outboard drive unit and tilt-lock system embodying the invention.

FIG. 2 is an enlarged detail view of the pivotable support bracket assembly, shown in the down position, for the drive unit of FIG. 1.

FIG. 3 is an enlarged detail view of the pivotable support bracket assembly, shown in the up position, for the drive unit of FIG. 1.

FIG. 4 is an enlarged cross-sectional view of a tilt-lock mechanism, illustrating a first embodiment of the invention.

FIG. 5 is a cross-sectional view of the tilt-lock mechanism, taken along lines 5—5 of FIG. 4.

FIG. 6 is a partial cross-sectional view of the tilt-lock mechanism, taken along lines 6—6 of FIG. 5.

- FIG. 7 illustrates the tilt-lock mechanism when the outboard drive unit is in its fully lowered or normal running position;
- FIG. 8 illustrates the tilt-lock mechanism when the outboard drive unit is being raised by the operator;
- FIG. 9 illustrates the tilt-lock mechanism when the outboard drive unit is raised to its fully lifted position;
- FIG. 10 illustrates the response of the tilt-lock mechanism when the drive unit collides with a submerged obstacle, thereby forcing it upwardly; and
- FIG. 11 illustrates the tilt-lock mechanism as it lowers the drive unit back to its normal running position after it has cleared the submerged obstacle.

FIGS. 12 and 13 are schematic representations of a second embodiment of the tilt-lock mechanism of the invention, illustrating various stages of its operation, wherein:

- FIG. 12 represents the tilt-lock mechanism when the outboard drive unit is in its lowered running position; and
- FIG. 13 represents the condition of the tilt-lock mechanism as the operator raises the drive unit out of the water.

FIGS. 14 through 17 are schematic representations of a third embodiment of the tilt-lock mechanism of the invention, illustrating various modes of drive unit operation, as follows:

- In FIG. 14, the drive unit has been locked into its fully lowered position;
- In FIG. 15, the drive unit is being raised by the operator;
- In FIG. 16, the fully lowered drive unit has collided with a submerged obstacle; and
- In FIG. 17, the drive unit has collided with a submerged article while in a partially lowered position.

FIG. 18 is a schematic representation of a fourth embodiment of the tilt-lock mechanism of the invention.

DETAILED DESCRIPTION OF THE PREFERRED EMBODIMENTS

Figure 7:
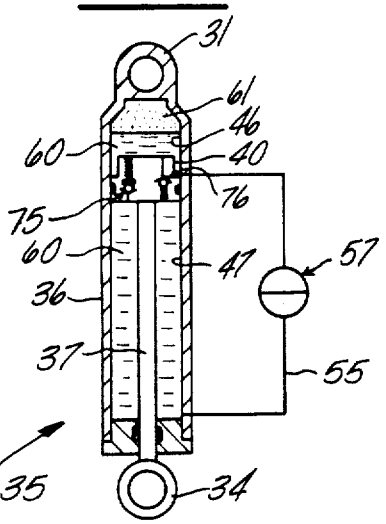
FIGS. 7 through 11 are schematic representations of the tilt-lock mechanism of FIG. 1, illustrating various stages of its operation as follows.

For purposes of describing and illustrating the principles and function of the invention, the drawings illustrate an outboard engine unit, generally referred to herein as a drive unit. The invention is not so limited, however, as it is equally applicable to vessels having inboard engines with outboard stern-drive apparatus as well as other vessels having vertically pivotable stern-drive configurations.

FIG. 1 illustrates a typical outboard drive unit 10 pivotally attached to a transom 11 of a marine vessel 12. Drive unit 10 includes a power head 13, a drive shaft housing 14, and lower unit 15, including a propeller 16. Drive unit 10 is pivotally attached, for vertical and steering movement, to transom 11 by a support bracket assembly 20, which is illustrated in detail in FIGS. 2 and 3. Drive unit 10 is illustrated in solid lines in its down position, and in broken lines in up, or lifted position, in FIG. 1.

In FIGS. 2 and 3, the support bracket assembly 20 includes a transom attachment bracket 21 pivotally connected to the drive unit support member 22 by a pivot pin 23, the transom attachment bracket 21 is generally U-shaped, in cross-section, when viewed from its top side, having a pair of rearwardly-extending legs 24 (only the the left-hand leg of which is shown). Each of the legs 24 has a series of trim apertures **26*a*, 26*b* and 26*c* extending laterally therethrough for receiving a laterally-extending trim bar 27 therein. When the drive unit 10 is in its down position, as is illustrated in FIGS. 1 and 2, an indentation 28 on the drive unit support member 22 abuttingly engages a trim bar 27 so as to restrain the drive unit 10 from further downwardly pivoting movement. Thus, the attitude angle 30 of drive unit 10 with respect to the transom 11 may be selectively varied by the operator in accordance with desired operating conditions merely by inserting the trim bar 27 in the appropriate set of trim apertures 26*a*, 26*b* or 26*c* in the transom attachment bracket 21**.

A lock-up pawl 32 is pivotally attached to the drive unit support bracket 22 and may be swung upwardly to allow the drive unit 10 to be pivotally lowered to its down position. When swung downwardly to engage the upper surface 33 of the transom attachment bracket 21, the lock-up pawl 32 holds the drive unit 10 in its raised position.

The tilt-lock mechanism 35 extendibly connects the transom attachment bracket 21 with the drive unit support member 22. The tilt-lock mechanism 35 includes a cylinder 36, which is pivotally attached at a cylinder fitting 31 to the drive unit support member 22, and a rod 37, which is pivotally attached at a rod fitting 34 to the transom attachment bracket 21.

FIGS. 4 through 6 illustrate the details and internal structure of the tilt-lock mechanism 35, which is a first embodiment of the invention. The cylinder 36 has a cylinder bore 38 in which a piston 40 is slidably received. The piston 40 is secured to the inner end of the rod 37. The intermediate portion of rod 37 protrudes through a rod aperture 42 in a closure member 41 and sealingly engages rod sealing member 44. The closure member 41 threadably engages an internally threaded, open end of the cylinder 36, with a cylinder sealing member 43 in sealing engagement therebetween. The closure member 41 also preferably includes a recess 48 in its outer or lower end.

The piston 40 sealingly engages the cylinder wall 38, by means of a piston sealing member 45, and thus divides the inside of the cylinder 36 into two variable volume chambers, a cylindrical chamber 46 and an annular chamber 47. The annular chamber 47 is completely filled, and the cylindrical chamber 46 is partially filled, with hydraulic fluid 60, the remainder of the cylindrical chamber 46 containing a compressible inert gas 61. The hydraulic fluid 60 may be selected from any of the suitable hydraulic fluids known to those skilled in the art, such as those used in hydraulic shock absorbers commonly found on land vehicles. The inert gas 61 is preferably nitrogen, but may be selected from any compressible inert gas known in the art that may be safely used in direct contact with hydraulic fluids and in close proximity with internal combustion engines.

Piston 40 includes a hollow, recessed open end 68 which provides communication between the cylindrical chamber 46 and a first communication passage 70 and a second communication passage 71. The first and second communication passages 70 and 71, respectively, extend longitudinally through the piston 40 and contain a first check valve 75 and a second check valve 76, respectively.

The first check valve 75 includes a ball 79 which is resiliently biased into seating engagement with a valve seat 80 by means of a spring 81 compressed between a first retaining ring 82 and a ball socket member 83. A spring stabilizer 84 protrudes downwardly, as viewed in FIG. 4, and extends coaxially within the spring 81 to prevent the spring 81 from buckling under axial loading and also to limit the upward travel of the ball 79 and the ball socket member 83. If the piston 40 is urged downwardly, thereby tending to decrease the volume of the annular chamber 47, the first check valve 75 opens when the reactive force exerted upon the ball 79 by the hydraulic fluid 60 in the annular chamber 47 exceeds a predetermined value and overcomes the counteracting forces exerted upon the ball 79 by the spring 81 and by the hydraulic fluid 60 in the cylindrical chamber 46.

The second check valve 76 includes a ball 89 which is resiliently biased into seating engagement with a valve seat 90 by means of a spring 91 compressed between a second retaining ring 92 and the ball 89. The second check valve 76 opens when the force exerted upon the ball 89 by the hydraulic fluid 60 in the cylindrical chamber 46 exceeds a predetermined level so as to overcome the counteracting forces exerted upon the ball 89 by the spring 91 and by the hydraulic fluid 60 in the annular chamber 47.

The cylindrical chamber 46 may communicate with the annular chamber 47 by way of a first bypass port 54, a bypass passage 55, and a second bypass port 56. Such communication is controlled by a selectively operable bypass valve 57. The piston 40 preferably includes a large-diameter shoulder portion 50 at its lower end, and a reduced diameter portion 51 at its upper end, as viewed in FIG. 4. When the rod 37 is fully retracted into the cylinder 36, the above-described indentation 28 on the drive unit supportment 22 abuttingly engages the trim bar 27 (see FIGS. 2 and 3) to limit the retraction of the piston 40 into the cylinder 36. Such retraction is limited so as to prevent the larger-diameter shoulder portion 50 of the piston 40 from blocking the first bypass port 54, thereby maintaining communication between the bypass port 54 and the cylindrical chamber 46. Such a configuration of the piston is provided to permit the bypass port 54 to be located at a low enough level in the cylinder 36 such that the bypass port 54 is always below the level of the hydraulic fluid 60 in the cylindrical chamber 46 and yet is not blocked by the piston 70 in its uppermost position. Fill plug 63 is provided in a fill port 64 for recharging cylinder 36 with hydraulic fluid or inert gas during servicing.

FIGS. 5 and 6 illustrate the details of one embodiment of the bypass valve 57 and its associated actuation mechanism. Bypass valve 57 is housed within a bypass valve bore 95, which extends laterally into the body of cylinder 36 and communicates with the first bypass port 54 and the bypass passage 55. The bypass valve 57 includes a ball 96 resiliently held in seating engagement with a bypass valve seat 97 by means of a biasing spring 98 which is compressed between a bypass valve closure plug 99 and the ball 96.

The ball 96 is urged away from the bypass valve seat 97 to open the bypass valve 57 by lateral movement of a pin 100. The pin 100 is slidably received in a pin bore 104 which extends laterally between the bypass valve bore 95 and an actuator bore 105. The actuator bore 105 extends into the body of cylinder 36 and houses a cam member 107 which is keyed to an actuator shaft 108 preferably by a set screw member 109. The pin 100 is held in abutting engagement with the circumferential periphery of the cam member 107 by means of the biasing force exerted on the pin 100 by the biasing spring 98 acting through the ball 96. As the actuator shaft 108 is rotated by the operator, the bypass valve 57 is closed when the pin 100 retracts to abut a flat surface 110 of the cam member 107, and is opened when the pin 100 is extended by a cylindrical surface 111 of the cam member 107. Spring 112 urges ball 113 into engagement with detent 114 on cam member 107 to releaseably hold bypass valve in its open position until selectively closed by the operator.

The function of the tilt-lock mechanism 35 under various operating conditions may be best understood with reference to FIGS. 7 through 11. As viewed in FIG. 7, the piston 40 is fully retracted upwardly into the cylinder 36, the bypass valve 57 is closed, and the inert gas 61 is compressed, such as would occur when the drive unit 10 is lowered into its down or running position shown in solid lines in FIG. 1. In this condition, any rearwardly directed forces on the drive unit 10 such as those normally resulting from decelerating of the vessel or running the drive unit 10 in reverse would tend to urge the cylinder 36 in an upward direction relative to the rod 37 and the piston 40. Because the bypass valve 57 is closed in FIG. 7, the hydraulic fluid 60 in the annular chamber 47 cannot flow through the bypass passage 55, and thus the downward force of the piston 40 causes the hydraulic fluid pressure in the annular chamber 47 to increase. However, the increased pressure in the annular chamber 47 resulting from such rearward forces on the drive unit 10 is not normally sufficient to overcome the biasing force of the spring 81 and open the first check valve 75. Therefore, the hydraulic fluid 60 in the annular chamber 47 is trapped, and any upward movement of the cylinder 36 relative to the piston 40 is resisted, thereby maintaining the drive unit 10 in its down or running position.

Figure 8:
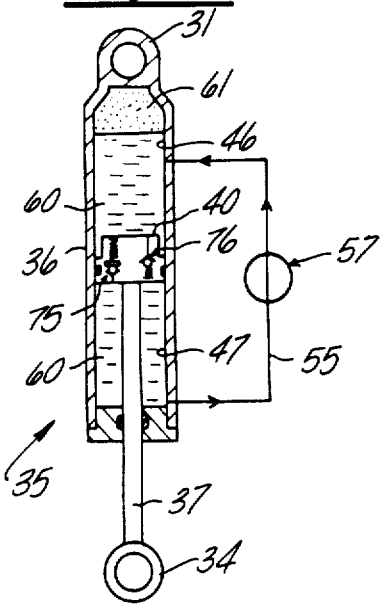

In the condition illustrated by FIG. 8, the operator has opened the bypass valve 57 so as to tilt the drive unit 10 upwardly to its lifted position, shown in broken lines in FIG. 1, for purposes of storage or in order to transport the vessel across a ford or through an area of dense marine vegetation. As the drive unit 10 is tilted, the cylinder 36 is extended upwardly, thus reducing the volume of the annular chamber 47. The reduction in the volume of the annular chamber 47 forces the hydraulic fluid 60 through the bypass passage 55 into the cylindrical chamber 46.

Figure 9:
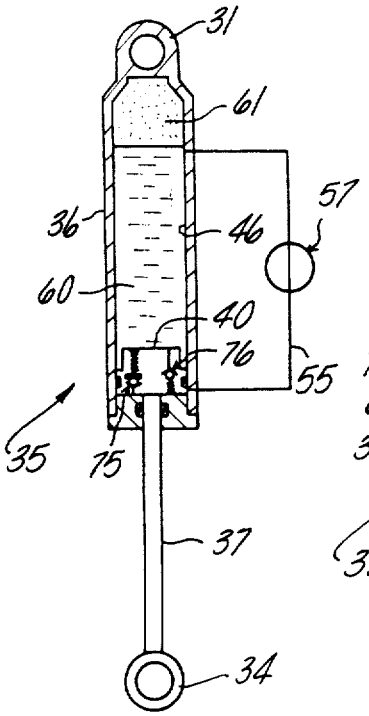

If the drive unit 10 is tilted to its fully lifted position, the cylinder 36 moves upwardly such that the rod 37 and the piston 40 force virtually all of the hydraulic fluid 60 into the cylindrical chamber 46 as is illustrated in FIG. 9. The upward movement of the cylinder 36 also allows the inert gas 61 to expand to fill the volume of the cylinder 36 that is no longer occupied by the portion of the rod 37 that has extended out of the cylinder 36. The first bypass port 54 (see FIG. 4) is vertically positioned so as to always be below the level of the hydraulic fluid 60 in the cylindrical chamber 46, as is discussed above, thereby preventing entry of the inert gas 61 into the bypass passage 55.

If the operator closes the bypass valve 57 while the rod 37 and the piston 40 are in an extended position and then releases the drive unit 10, the weight of the drive unit 10 exerts a force on the cylinder 36 in a downward direction relative to the piston 40. Such force is great enough to pressurize the cylindrical chamber 46 sufficiently to overcome the force of the spring 91 and open the second check valve 76. The hydraulic fluid 60 is thus allowed to flow from the cylindrical chamber 46 through the second check valve 76 into the annular chamber 47, thereby allowing the rod 37 and the piston 40 to retract and dampingly lower the drive unit 10 to its down position. As the rod 37 and the piston 40 retract, the inert gas 61 is compressed to compensate for the volume of the cylinder 36 that is now occupied by the retracted rod 37. In order to maintain the drive unit 10 in its up or lifted position, the operator merely pivots the lock-up pawl 32 on the drive unit support member 22 downwardly to engage the upper surface 33 of the transom attachment bracket 21, as is illustrated in FIGS. 1 through 3.

Figure 10:
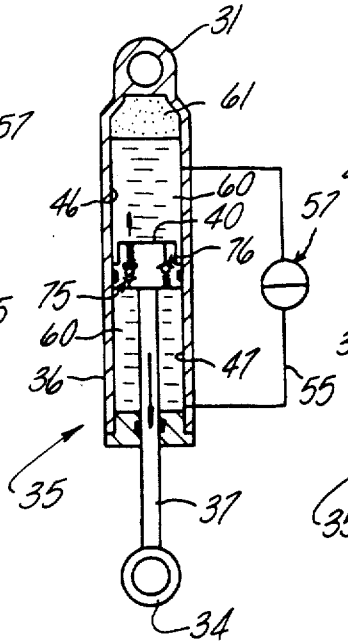
Figure 11:
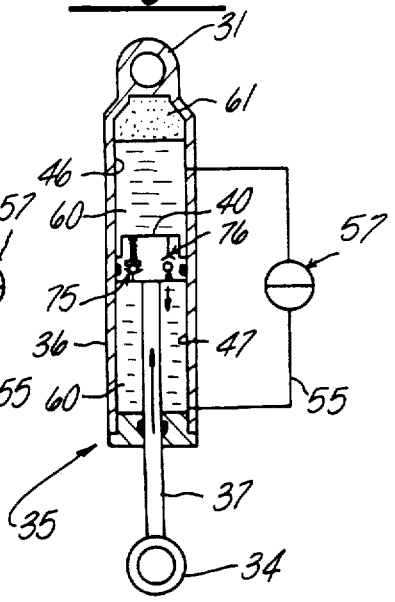

FIGS. 10 and 11 schematically illustrate the function of the tilt-lock mechanism 35 in the event that the drive unit 10 collides with a submerged obstacle. Since the bypass valve 57 is closed, such a collision causes a sudden upward force on the cylinder 36, thereby increasing the hydraulic fluid pressure in the annular chamber 47 sufficiently to overcome the spring 81 and to open the first check valve 75, as shown in FIG. 10. As a result, the hydraulic fluid 60 in the annular chamber 47 is forced through the first check valve 75 into the cylindrical chamber 46. The cylinder 36 extends upwardly, allowing the drive unit 10 to swing upwardly to prevent, or at least minimize, the impact damage to the drive unit 10. As the cylinder 36 extends upwardly, the inert gas 61 expands to compensate for the volume of the cylinder 36 formerly occupied by the rod 37.

After the vessel has passed the submerged object and the drive unit 10 is released, the weight of the drive unit 10 urges the cylinder 36 downward relative to the piston 40, thus closing the first check valve 75 and pressurizing the cylindrical chamber 46 sufficiently to open the second check valve 76 as is illustrated in FIG. 11. The hydraulic fluid 60 in the cylindrical chamber 46 is then forced through the second check valve 76 into the annular chamber 47, allowing the cylinder 36 to retract downwardly and dampingly return the drive unit 10 to its lowered or running position.

Figure 12:
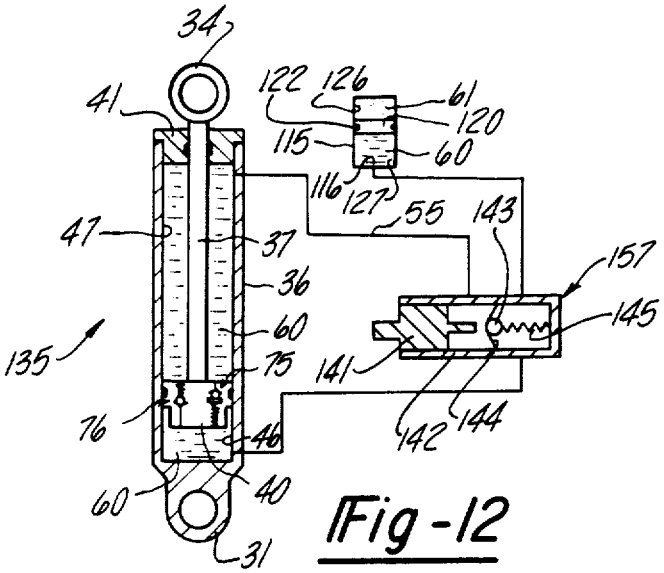
Figure 13:
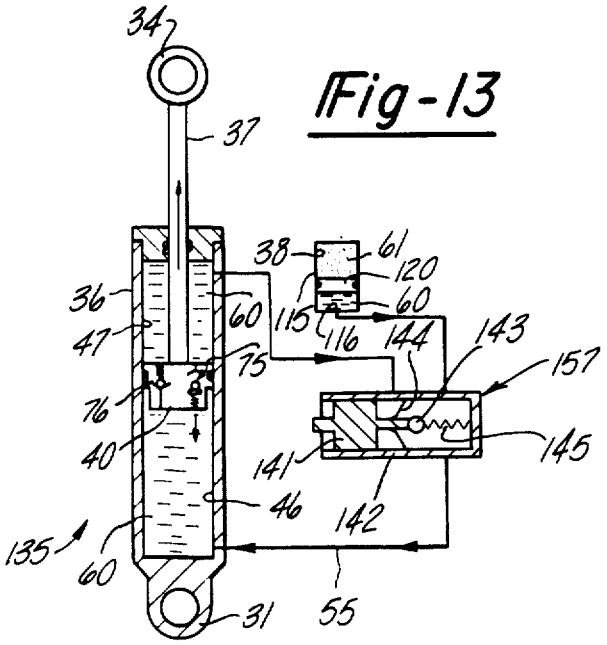

FIGS. 12 and 13 schematically illustrate a second embodiment of the invention. The tilt-lock mechanism 135 includes many of the same elements as the tilt-lock mechanism 35 described above. The piston 40 is connected to the rod 37 and is slidably received within the cylinder 36. The piston 40 divides the cylinder 36 into two variable-volume chambers, the cylindrical chamber 46 and the annular chamber 47. The two chambers are in selectively interruptible fluid communication through the bypass passage 55 and a bypass valve 157. For purposes of illustration only, the tilt-lock mechanism 135 has the fitting 34 of the rod 37 oriented for connection to the drive unit support member 22 and the fitting 31 of the cylinder 36 oriented for connection to the transom attachment bracket 21. Unless otherwise stated herein, the piston 40, the cylinder 36 and the components thereof are similar in structure and configuration to the like-numbered elements illustrated in FIGS. 1 through 11 for the tilt-lock mechanism 35.

The major differences between the tilt-lock mechanism 135 and that of the first embodiment lie in the structure of the bypass valve 157, as compared to the bypass valve 57, and in the provision of a separate accumulator 115.

The accumulator 115 is closed except for inlet/outlet port 116 which provides communication with the bypass valve 157 by way of a communication passage 117. A floating barrier 120 is slidably received within the accumulator 115 and sealingly engages the inner wall thereof by means of a sealing member 122. The floating barrier 120 divides the accumulator 115 into two variable-volume chambers, a gas chamber 126, which contains the inert gas 61, and a fluid chamber 127, which receives the hydraulic fluid 60 from the cylinder 36 through the bypass passage 55 and the bypass valve 157. Because the inert gas 61 and the hydraulic fluid 60 are sealingly isolated by the floating barrier 120, the accumulator 115 may be positioned in any orientation. The tilt-lock mechanism 135 offers the advantage of also allowing the cylinder 36 to be installed in virtually any orientation due to the fact that the inert gas 61 is housed external to the cylinder 36 in the accumulator 115.

The bypass valve 157 includes a plunger 141 which is slidably received within a valve body 142. The valve body 142 also contains a ball 143 which is resiliently biased into seating engagement with a valve seat 144 by biasing spring 145. The bypass passage 55 is connected to the bypass valve 157 on opposite sides of the valve seat 144 such that when the plunger 141 slidably urges the ball 143 away from the valve seat 114, communication between the cylindrical chamber 46 and the annular chamber 47 is established through the bypass passage 55. The communication passage 117 is connected to the bypass valve 157 on the same side of the valve seat 144 as is the portion of the bypass passage 55 that leads to the cylindrical chamber 46 of the cylinder 36. Thus the cylindrical chamber 46 is in continuous communication with the accumulator 115 whether the bypass valve 157 is open or closed.

When the bypass valve 157 is closed and the drive unit 10 is in its lowered or running position, the tilt-lock mechanism 135 is in the condition illustrated in FIG. 12. Any rearwardly-directed forces on the drive unit 10 such as those normally resulting from running the drive unit 10 in reverse or from deceleration or stopping of the vessel result in an upward force on the piston 40, thereby pressurizing the annular chamber 47. Since the bypass valve 157 is closed in FIG. 12, and since such resultant pressure in the annular chamber 47 is normally insufficient to open the first check valve 75, the piston 40 is restrained from moving in the cylinder 36 and thus the drive unit 10 is held in its lowered or running position. If, however, the rearward forces on the drive unit 10 result from impact with a submerged obstacle, a high-magnitude shock load is imposed on the piston 40 in the upward direction as viewed in FIG. 12. Such a large force pressurizes the annular chamber 47 sufficiently to open the first check valve 75. As a result, the hydraulic fluid 60 flows from the annular chamber 47 through the first check valve 75 into the cylindrical chamber 46, thus allowing the piston 40 and the rod 37 to extend so that the drive unit 10 may swing upwardly to prevent, or at least minimize, the impact damage. Simultaneously, the inert gas 61 in the accumulator 115 expands to force the hydraulic fluid 60 from the fluid chamber 127 through the communication passage 117 to fill the volume in the cylinder 36 equivalent to that formerly occupied by the extended rod 37 in the annular chamber 47.

In FIG. 13, the bypass valve 157 has been opened to allow the operator to swing the drive unit 10 to its lifted position for storage or for transporting the vessel over a ford or a submerged obstacle. As the drive unit 10 is lifted, the rod 37 and the piston 40 extend, thus reducing the volume of the annular chamber 47 and forcing the hydraulic fluid 60 through the bypass passage 55 into the cylindrical chamber 46. Simultaneously, the inert gas 61 expands to compensate for the increase in the available volume of the cylinder 36 caused by the extension of the rod 37. In order to retain the drive unit 10 in its lifted position, the operator may engage the lock-up pawl 32 with the upper surface 33 of the transom attachment bracket 21 as shown in FIGS. 1 and 3.

FIGS. 14 through 17 schematically illustrate a third embodiment of the invention, tilt-lock mechanism 235, which offers the distinct advantage of including a variable-position lock-up feature. Unless otherwise indicated, the elements of the tilt-lock mechanism 235 are similar to the like-numbered elements previously described in relation to the first and second embodiments.

The tilt-lock mechanism 235 differs from the previously-described embodiments primarily in the inclusion of a free-floating disc 236 which is slidably received within the cylindrical chamber 46. The free-floating disc 236 sealingly engages the inner wall of the cylinder 36 by means of a sealing member 237 and is releasably engageable with the piston 40. The free-floating disc 236 includes an end 240 adapted to abuttingly engage the piston 40 in a flush, mating relationship.

Figure 14:
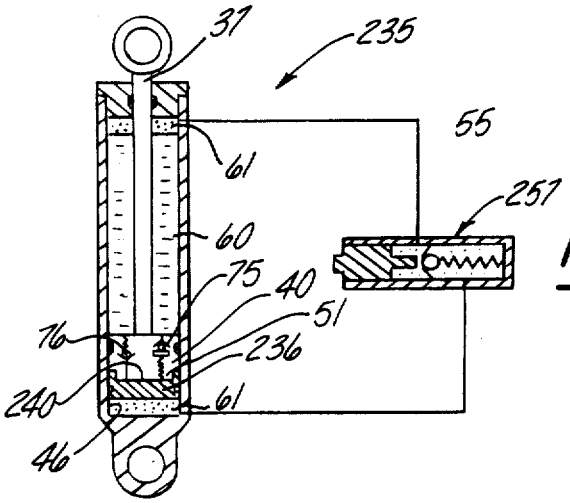

In FIG. 14, the drive unit 10 has been locked in its fully lowered position with the piston 40 fully retracted into the cylinder 36, engaging the free-floating disc 236, and with the bypass valve 257 closed. As discussed above for the previously-described embodiments, the normally encountered rearward forces on the drive unit 10 during deceleration or running in reverse are insufficient to cause the first check valve 75 to open. Thus the piston 40 is held in its fully retracted location in the cylinder 36, and the drive unit 10 is maintained in its fully lowered position.

Figure 15:
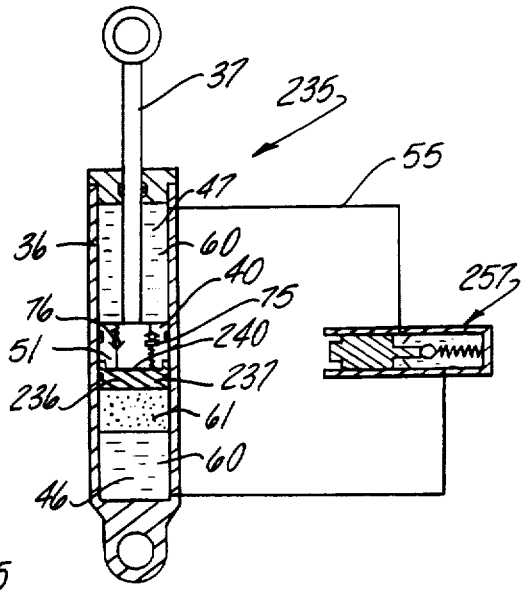

If the operator opens the valve 257, as is shown in FIG. 15, to swing the drive unit 10 upward, the piston 40 and the rod 37 extend. First, the inert gas 61 and then some of the hydraulic fluid 60 in the annular chamber 47 are forced through the bypass passage 55 into the cylindrical chamber 46. The inert gas 61 simultaneously expands to compensate for the increase in available cylinder volume caused by the extension of the rod 37.

The tilt-lock mechanism 235 allows the operator to selectively lock the drive unit 10 in any tilted position from fully lowered to fully raised. With the bypass valve 257 open as shown in FIG. 15, the drive unit 10 may be raised or lowered to the desired position thus extending or retracting the rod 37 and the piston 40. During such extension or retraction, the piston 40 forces the hydraulic fluid 60 or the inert gas 61, or both, to flow through the bypass passage 55 between the cylindrical chamber 46 and the annular chamber 47. Simultaneously, the inert gas 61 expands to compensate for the volume of the portion of the rod 37 that has been extended from the cylinder 36. The free-floating disc 236 is held in abutting engagement with the piston 40, as it extends or retracts, by the pressure of the inert gas 61 acting on the hydraulic fluid 60 in the cylindrical chamber 46. Once the bypass valve 257 is closed and the drive unit 10 is released, the free-floating disc 236 prevents the hydraulic fluid 60 in the cylindrical chamber 46 from opening the second check valve 76. Since the hydraulic fluid 60 in the cylindrical chamber 46 is thereby trapped, the rod 37 and the piston 40 are prevented from retracting, and the drive unit 10 is held in the selected position.

Figure 16:
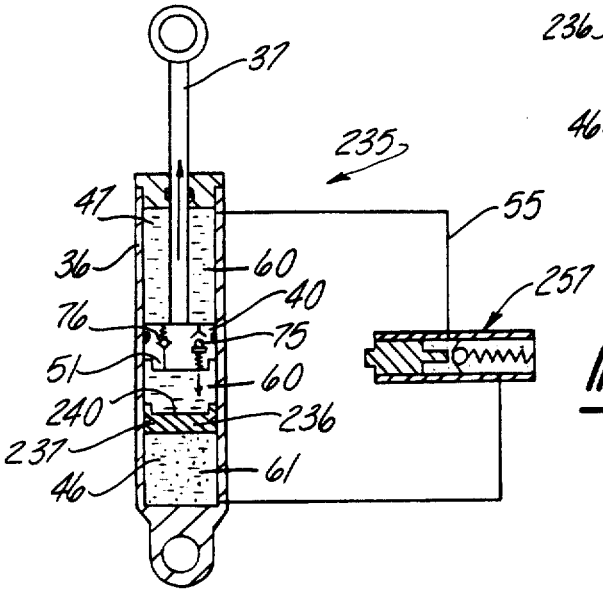

FIG. 16 illustrates the function of the tilt-lock mechanism 235 if the drive unit 10 collides with a submerged obstacle while in the fully lowered, or normal running, position shown in FIG. 14. The shock force of the collision on the drive unit 10 forces the rod 37 and the piston 40 to suddenly extend upwardly relative to the cylinder 36. Such sudden extension compresses such inert gas 61 as is at the top of the annular chamber 47 and that in the bypass passage 55, pressurizing the hydraulic fluid 60 in the annular chamber 47 sufficiently to open the first check valve 75 as shown in FIG. 16. As the rod 37 and the piston 40 suddenly extend, the free-floating disc 236 has a tendency to follow the piston 40 in its upward movement because of the pressure of the inert gas 61 acting on its lower face. As the free-floating disc 236 begins to move upwardly, however, the compressed inert gas 61 below the free-floating disc 236 in the bottom of the cylindrical chamber 46 expands due to the increased available volume caused by the upward movement of the piston 40 and the free-floating disc 236. Such expansion of the inert gas 61 in the cylindrical chamber 46 rapidly lowers its pressure and thereby reduces its upwardly-directed force on the bottom of the free-floating disc 236. As a result, a pressure differential is created across the free-floating disc 236 between the high pressure hydraulic fluid 60 rushing through the first check valve 75 and the reduced pressure inert gas 61 in the cylindrical chamber 46. Such pressure differential rapidly becomes great enough to forcibly disengage the free-floating disc 236 from the piston 40, thereby allowing the piston 40 and the rod 37 to continue to extend. Consequently, the drive unit 10 is allowed to swing upwardly to prevent or minimize any damage from the impact with the submerged obstacle.

After the vessel passes over the obstacle, the weight of the drive unit 10 forces the rod 37 and the piston 40 downwardly, as shown in FIG. 17. Such downward force pressurizes the cylindrical chamber 46 sufficiently to close the first check valve 75 and open the second check valve 76, thus allowing the hydraulic fluid 60 between the piston 40 and the free-floating disc 236 to return to the annular chamber 47. Simultaneously, the inert gas 61 in the annular chamber 47 expands and the inert gas 61 in the cylindrical chamber 46 is compressed. Finally, the rod 37 and the piston 40 continue to retract, returning the drive unit 10 to its fully-lowered position shown in FIG. 14.

FIG. 18 schematically illustrates a fourth embodiment of the invention, substantially similar to the third embodiment shown in FIGS. 14 through 17. The primary difference between the tilt-lock mechanism 335 and the third embodiment lies in the inclusion of a floating barrier 346 below the free-floating disc 236.

The floating barrier 346 serves as a sealed movable barrier between the inert gas 61 and the hydraulic fluid 60 in the cylindrical chamber 46, similar to the floating barrier 120 in the embodiment illustrated in FIGS. 12 and 13. The upward movement of the floating barrier 346 is limited by an annular ring 348 which is fixed at a location near the bottom of the cylinder 36, thereby forming an accumulator portion 350 within the cylindrical chamber 46.

The accumulator portion 350, like the accumulator 115 in FIGS. 12 and 13, continuously acts on the hydraulic fluid 60 located on one side of the bypass valve 257 through the central aperture of the annular ring 348.

The tilt-lock mechanism 335 therefore combines the functions, features and advantages of the above-described second embodiment, the tilt-lock mechanism 135 (FIGS. 12 and 13), with those of the above-described third embodiment, the tilt-lock mechanism 235 (FIGS. 14 through 17). However, the tilt-lock mechanism 335 includes an additional advantage feature in that the floating barrier 346 isolates the hydraulic fluid 60 below the free-floating disc 236 from the inert gas 61 in the bottom of the cylindrical chamber 46. Thus, any tendency of the hydraulic fluid 60 and the inert gas 61 to mix is prevented.

The foregoing descriptions represent merely exemplary embodiments of the invention. Furthermore, although the invention is described herein within the context of outboard marine drive units, the invention is not limited to such an application. One reasonably skilled in the art will readily recognize that the invention is equally applicable to other apparatus or systems having tiltable or pivotable articulated elements. Finally, various changes or modifications may be made in said embodiments without departing from the spirit or scope of the invention.

I claim:

1. In a marine vessel having a hull and an outboard drive unit carrying propelling means for propelling said vessel through the water pivotably attached thereto for movement about a generally horizontally extending tilt axis from a normal position wherein the propelling means is positioned beneath the water and a tilted up position wherein said propelling means is out of the water, a mechanism for damping the relative pivotal movement between said drive unit and said vessel about said tilt axis, said mechanism defining at least two fluid chambers and having restricted communication means for restrictively passing fluid between said chambers for damping the relative pivotal movement of said drive unit and said vessel, the improvement comprising fluid bypass means for selectively overriding said restricted communication means, thereby allowing free relative pivotal movement of said drive unit and said vessel about said tilt axis.

2. The improvement according to claim 1, wherein said restricted communication means is adapted to restrictively pass fluid in either direction between said fluid chambers, said fluid bypass means being adapted for selectively overriding said restricted communication means in either of said directions.

3. The improvement according to claim 2, further comprising means for selectively disabling said restricted communication means in one of said directions in order to prevent fluid from passing between said chambers in said one direction, thereby limiting the relative pivotal movement of said drive unit and said vessel in a pivotal direction corresponding to fluid flow in said one direction.

4. The improvement according to claim 3, wherein said bypass means comprises a conduit having a valve therein for selectively permitting and preventing fluid flow therethrough.

5. The improvement according to claim 1 or 3, wherein said fluid includes a liquid and a gas, the improvement further comprising fluid accumulator means containing a portion of said liquid and said gas in a mutually pressure responsive relationship, said gas being expandable and contractable in response to increases and decreases in the volume of said fluid chambers available to be occupied by said liquid as a result of relative pivotal movement of said drive unit and said vessel.

6. The improvement according to claim 5, wherein said accumulator means includes a floating barrier therein for floatingly isolating said liquid from said gas, said liquid being in constant communication with at least one of said fluid chambers.

7. The improvement as set forth in claim 1 wherein the damping mechanism comprises a sealed cylinder having a piston and a piston rod slidably moveable therein, one of said piston and piston rod being affixed relative to the hull and the other being affixed to the drive unit for relative movement therebetween upon pivotal movement of said drive unit about said tilt axis, and a fluid contained within said cylinder on opposite sides of said piston, said piston having a pair of restricted flow passages therethrough, each of said flow passages having one-way valve means therein, said pair of one-way valve means being oriented in opposite directions for restrictively passing fluid in either direction between said opposite sides of said piston, thereby damping said relative movement between said hull and said drive unit, the bypass means comprising a passage extending between opposite sides of said piston and having a bypass valve therein for selectively allowing said fluid to pass freely between said opposite sides of said piston, thereby allowing free relative movement of said drive unit relative to said hull.

8. The improvement according to claim 7, further comprising disabling means for preventing said restricted flow through one of said restricted flow passages, thereby preventing said relative movement of said members when said bypass valve is selectively closed.

9. The improvement according to claim 8, wherein said disabling means includes a floating disc releaseably engageable with one side of said piston, thereby preventing flow from the opposite side of said piston to said one side of said piston.

10. The improvement according to claim 7 or 9, wherein said fluid includes a liquid and a gas, the improvement further comprising fluid accumulator means containing a portion of said liquid and said gas in a mutually pressure responsive relationship, said gas being expandable and contractable for compensating for increases and decreases in the volume of said cylinder available to be occupied by said liquid as a result of movement of said piston rod out of and into said cylinder.

11. The improvement according to claim 10, wherein said accumulator means includes a floating barrier therein for floatingly isolating said liquid from said gas, said liquid being in constant communication with said cylinder.

* * * * *